US006452567B1

(12) United States Patent
Overton

(10) Patent No.: US 6,452,567 B1
(45) Date of Patent: Sep. 17, 2002

(54) GEARED ANTENNA AIMING SYSTEM AND METHOD

(75) Inventor: Steven R. Overton, Seattle, WA (US)

(73) Assignee: Harris Broadband Wireless Access, Inc., Bellevue, WA (US)

( * ) Notice: Subject to any disclaimer, the term of this patent is extended or adjusted under 35 U.S.C. 154(b) by 0 days.

(21) Appl. No.: 09/893,013

(22) Filed: Jun. 28, 2001

Related U.S. Application Data

(60) Provisional application No. 60/266,485, filed on Feb. 6, 2001.

(51) Int. Cl.[7] ..... H01Q 1/12
(52) U.S. Cl. ..... 343/891; 343/882; 343/892
(58) Field of Search ..... 343/890, 891, 343/892, 878, 880, 882, 757, 761, 765

(56) References Cited

U.S. PATENT DOCUMENTS

| | | | | | |
|---|---|---|---|---|---|
| 4,841,309 | A | * | 6/1989 | Burr | 343/766 |
| 5,657,031 | A | * | 8/1997 | Anderson et al. | 343/757 |
| 6,016,313 | A | * | 1/2000 | Foster, Jr. et al. | 370/330 |
| 6,037,913 | A | * | 3/2000 | Johnson | 343/882 |
| 6,342,870 | B1 | * | 1/2002 | Mehrkens et al. | 343/891 |

* cited by examiner

*Primary Examiner*—Don Wong
*Assistant Examiner*—Hoang Nguyen
(74) *Attorney, Agent, or Firm*—Duane Morris LLP

(57) ABSTRACT

A spring loaded antenna mounting system for the directional antennae of a point-to-multipoint millimeter wave communication system and methods of supporting such antennae for selectively directing the beam thereof. The adjustment of the antenna in two orthogonal directions is disclosed as is a quick connect/disconnect latch for attaching the individual antenna element to the antenna mount.

12 Claims, 9 Drawing Sheets

GEARED ANTENNA AIMING SYSTEM AND METHOD

The present application claims the priority of U.S. Provisional Application Ser. No. 60/266,485 filed Feb. 6, 2001 for "Antenna Provisional," the disclosure of which is hereby incorporated herein by reference. This application is related to and is being concurrently filed with commonly assigned U.S. patent application Ser. No. 09/863,010, entitled Spring Loaded Antenna Mounting System and Method and Ser. No. 09/893,007, entitled Antennae Quick-Connect System and Method, the disclosures of which are hereby incorporated herein by reference. The present invention relates generally to antenna mounting systems and methods for wireless communication systems, and more specifically to antennae mounting systems and methods for millimeter wave point-to-multipoint communication systems.

BACKGROUND

Point-to-multipoint millimeter wave wireless communication systems are well know and are described, e.g., in the commonly assigned U.S. Pat. No. 6,016,313, entitled "System and Method for Broadband Millimeter Wave Data Communication." Such systems generally consist of one or more hubs each servicing a plurality of remote nodes. The antennae of such systems are highly directional and it is critical to the successful operation of the communication system that each antennae be correctly aimed in both azimuth and elevation. It is accordingly an object of the present invention to provide a novel antennae mounting system which may be selectively aimed in both azimuth and elevation.

Point-to-multipoint communication systems are generally modular with reconfiguration of the coverage of the antennae required, e.g., as the number of subscribers increases within a sector, as subscribers come on line in sectors previously not serviced, as the communication traffic increases within a sector, etc. It is therefore another object of the present invention to provide a novel antennae mounting system and method in which antennae be easily added or moved to effect reconfiguration of the antennae system to accommodate the dynamic changes in the communication system.

Antennae in such systems are often mounted on preexisting structures and there are often physical limitations placed on the construction of new antenna support structures. It is accordingly a further object of the present invention to provide a novel antennae mounting system and method in which the antennae which may be easily and quickly installed on a variety of support structures.

Further, there are difficulties in the installation and aiming of directional antennae, where space is confined and a single installer may be faced with the simultaneous positioning and installation of an antenna at a significant elevation exposed to adverse wind conditions. It is accordingly yet another object of the present invention to provide a novel antennae mounting system and method in which the antennae may be quickly removed or quickly installed and thereafter selectively secured and aimed.

These and other objects and advantages will be readily apparent from the following detailed description of illustrative embodiments when read in conjunction with the appended drawings.

DETAILED DESCRIPTION

Figure 1:
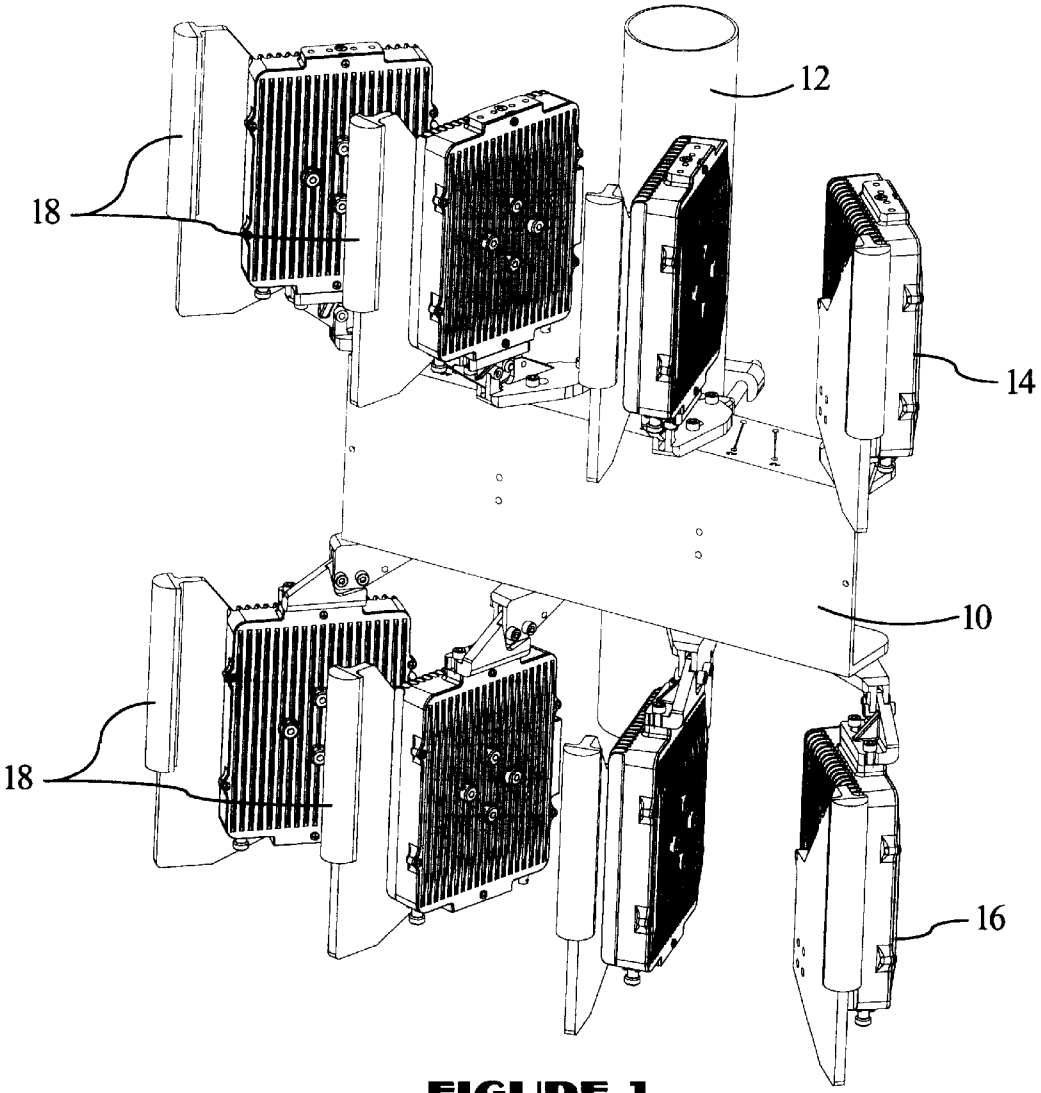
FIG. 1 is a pictorial view of a typical point-to-multipoint hub antenna.

FIG. 1 illustrates a typical hub mounting for plural antennae in a millimeter wave point-to-multipoint wireless communication system. In the embodiment shown, there is a mounting plate 10 secured in a conventional manner to a tubular support 12. Two rows of antennae are illustrated, with the top row 14 having a different degree of elevation than the bottom row 16 to service relatively far and near subscribers respectively. Within each row, each highly directional antennae 18 is offset in azimuth by fifteen degrees to service an area approximately sixty degrees wide.

Figure 2:
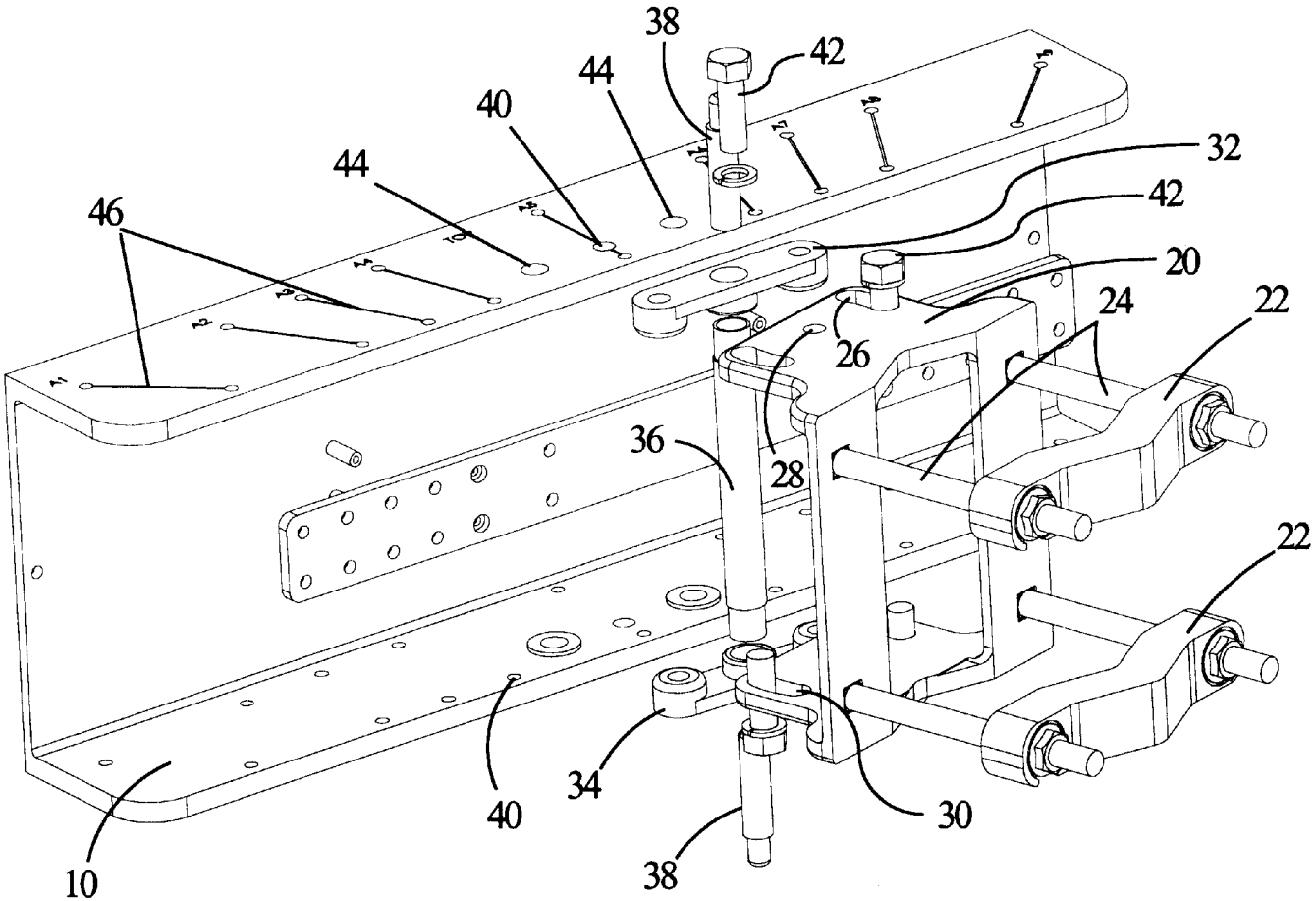
FIG. 2 is an exploded view of one embodiment of the spring loaded antenna mount of the present invention.

As shown in FIG. 2, the mounting plate 10 may be mounted on the pole 12 (not shown) by means of a mounting bracket 20 notched to receive the pole and having two notched backing members 22 secured thereto by way of four bolts 24. The upper and lower flanges 26 of the pole bracket 20 desirably include a central opening 28 and two generally arcuate slots 30 into which are received three protrusions of a top and bottom plate 32,34. Disposed between the flanges 26 is a spring biased pin comprising a central tube 36 which houses a coil spring (not shown) held under relatively slight compression by two end protrusions 38. The protrusions 38 are restrained by any suitable conventional means from completely exiting the tube 36. The pole bracket is relatively easy to install because of its small size and light weight.

With continued reference to FIG. 2, the mounting plate 10 may then be secured to the mounting bracket 20 without the necessity for precise alignment. One of he pins 38 may be depressed into the tube 36 against the pressure of the spring sufficiently to permit the flange of the mounting bracket to slide over the plates 32,34 to align the holes 40 therewith, at which point the pins 38 extend through the holes 40 under the bias of the spring within the tube 36. At this point, the bracket 10 is secured to the mounting bracket 20 and the installer no longer has to deal with the weight of the mounting bracket.

With the pins 38 extended, the bolts 42 may be positioned in the holes 44 in the mounting bracket, through the holes in the plates 32 and the arcuate slots 30. The mounting bracket 10 may then be turned in azimuth relative to the pole bracket 20 and tightened to fix the position thereof relative to the slots 30. Minor adjustments in azimuth may thus be made in the orientation of the mounting bracket 10 without the need for adjusting the mounting of the pole bracket 20 to the pole 12.

As shown in FIG. 2, the flanges of the mounting bracket may be provided with pre-punched holes and lines 46 indicating the alignment of antenna elements relative to the bracket and thus to each other. Installation of the individual antennae to the bracket 10 may thus be facilitated and the relative alignment of the antennae secured without individually aligning the antenna elements.

Note that at no point in the installation is the installer required to deal with the weight of a pre-assembled antenna nor individually adjust the antenna elements.

Figure 3:
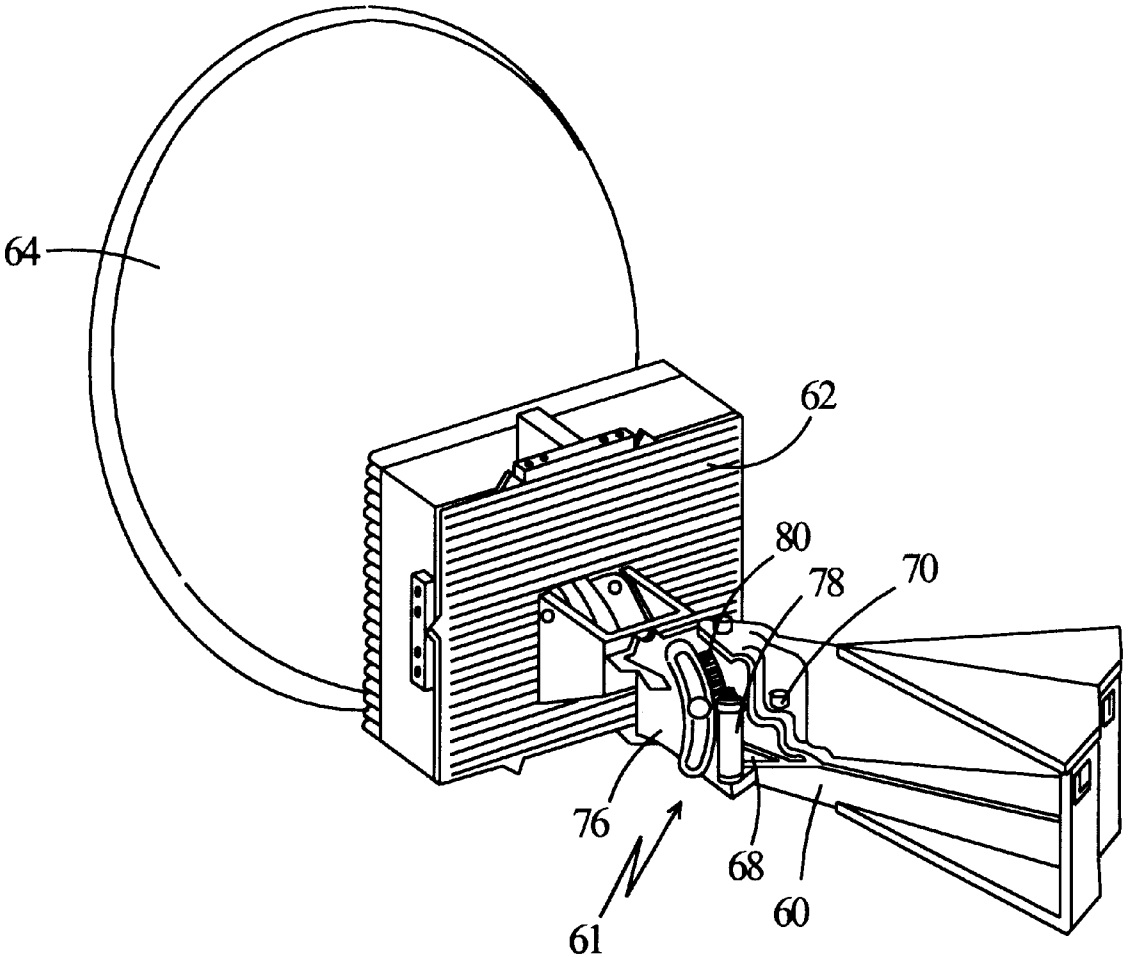
FIG. 3 is a pictorial view of an embodiment of a parabolic antenna mount of the present invention illustrating two degrees of adjustment.
Figure 4:
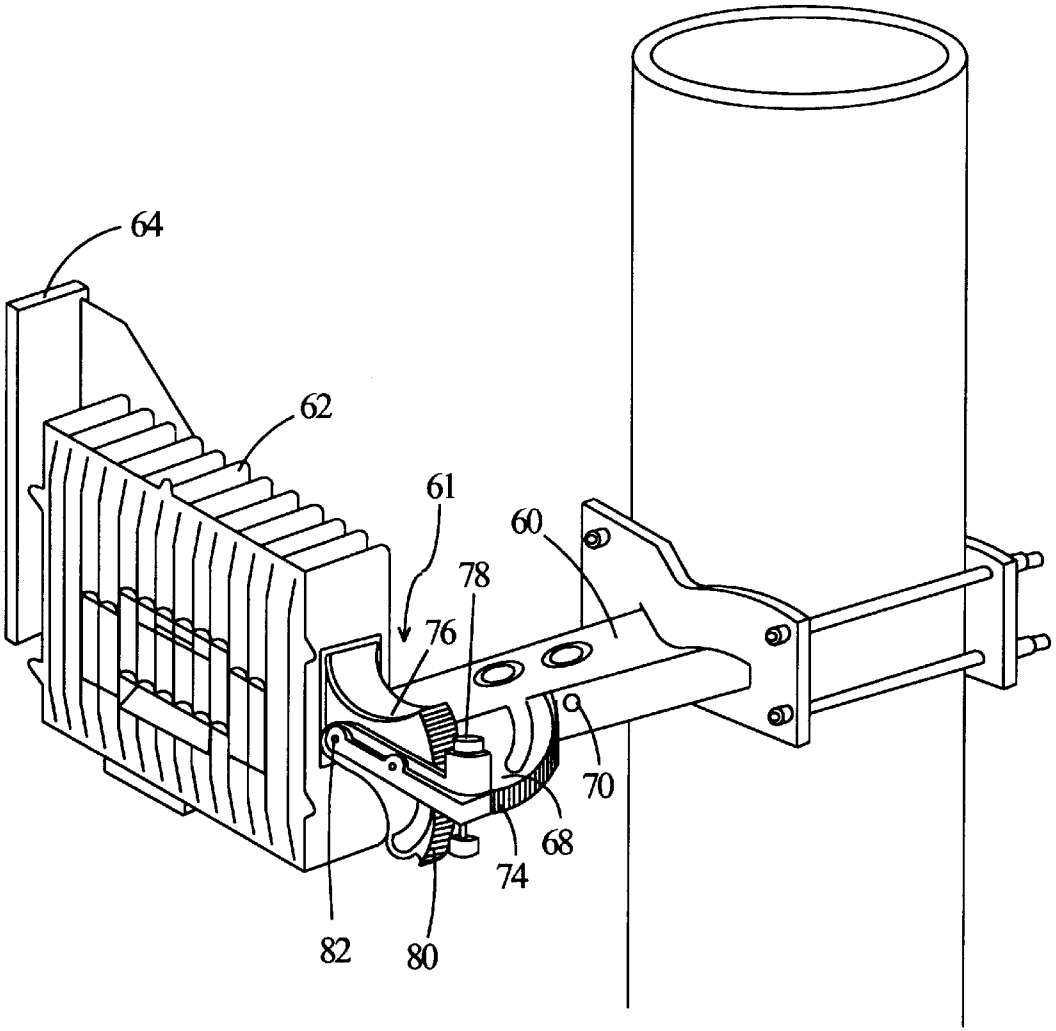
FIG. 4 is a pictorial view of an embodiment of a dipole antenna mount of the present invention illustrating two degrees of adjustment.
Figure 5:
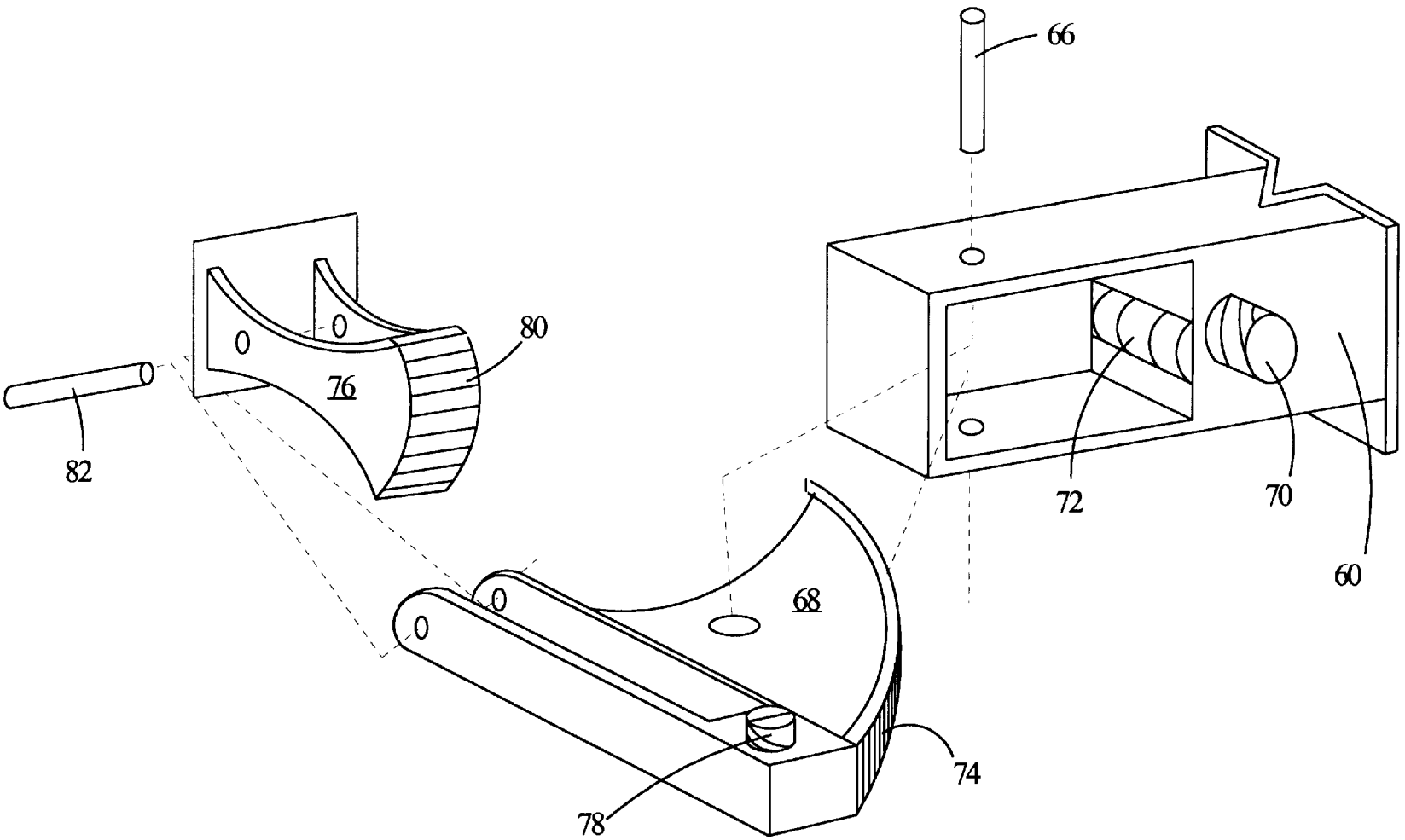
FIG. 5 is a schematic exploded view of one mechanism for achieving the two degrees of adjustment in the embodiments of FIG. 3 and FIG. 4.

In the embodiment shown in FIG. 2, adjustments in elevation must be made by the adjustment of the antenna bracket 10 to the pole 12 or the individual antennas (not shown) to the bracket 10. However, FIGS. 3–5 illustrate an antenna bracket which facilitates adjustments in both elevation and azimuth. With reference to FIGS. 3–5 where like functional elements have been given like numeric designations, the pole mounting bracket 60 may be attached to the pole or other supporting structure in any suitable conventional way such as the manner illustrated in FIG. 2. The pole mounting bracket 60 supports the antenna mount 61 in the manner to be described infra. The antenna unit 62 including the actual antenna 64 is in turn supported by antenna mount 61.

As shown in FIG. 3 and 4 and schematically illustrated in FIG. 5, the pole bracket 60 includes a pivotal support 66 for a first adjustment member 68 the manually rotatable knob 70 of a threaded screw 72.

The first adjustable member 68 carries an arcuate threaded surface 74 which mates with the screw 72 when the first adjustable member is pivotally supported by the pin 66. In this way, the manual rotation of the knob 70 effects rotation of the first adjustable member 68 about the pin 66 to position the antenna in one orthogonal direction, azimuth or elevation as determined by the orientation of the pole mount 60.

The first adjustable member includes a pivotal support for a second adjustable member 76 and included a threaded manually operable knob 78 for a screw which engages a threaded arcuate surface 80 on the second adjustment member 76. In this way, rotation of the knob 78 effects rotation of the second adjustment member about the pin 82 to provide a second degree of adjustment orthogonal to the degree of adjustment provided by the first adjustment member 68.

The latching of the antenna unit to the second adjusting member may be accomplished in several ways. However, it is highly desirable that the antenna be quickly and easily replaced in both an individual node mount or as an element in a hub array. The quick disconnect latch shown in FIGS. 3 and 4 is illustrated more clearly in FIGS. 6–8 and the operation thereof is schematically illustrated in FIG. 9.

Figure 6:
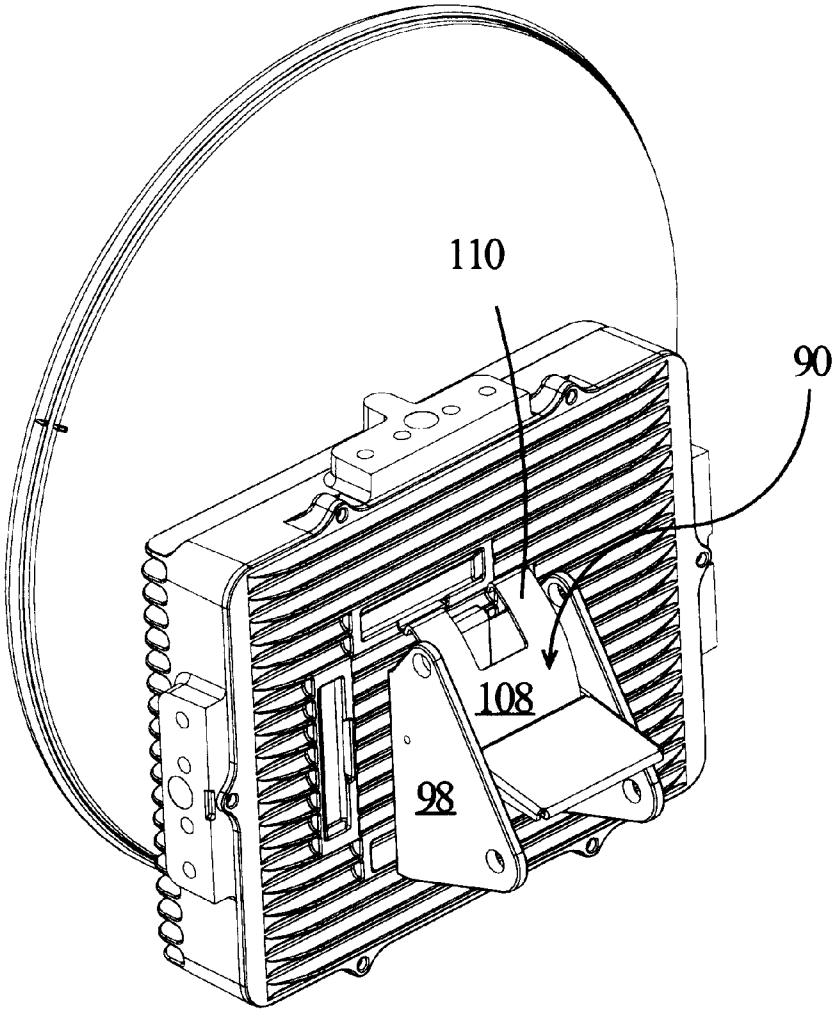
FIG. 6 is a pictorial view of one embodiment of the quick connect/disconnect latch mechanism of the present invention in the open position.
Figure 7:
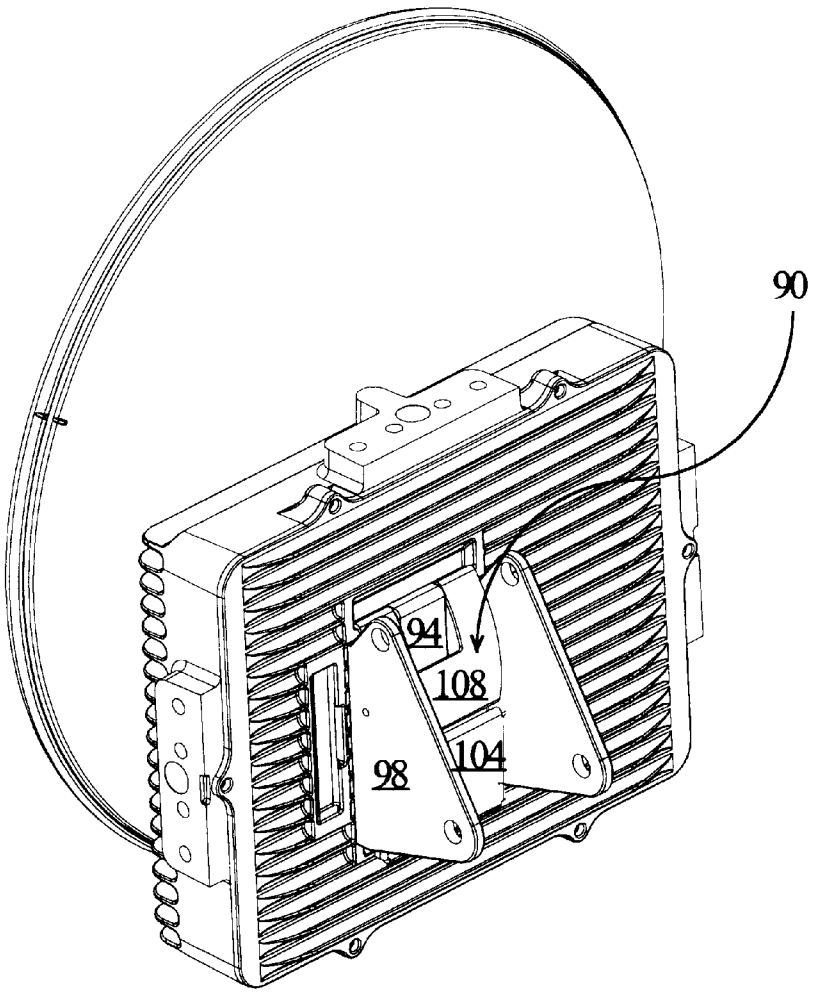
FIG. 7 is a pictorial view of the embodiment of the quick connect/disconnect latch mechanism illustrated in FIG. 6 in the latched or closed position.
Figure 8:
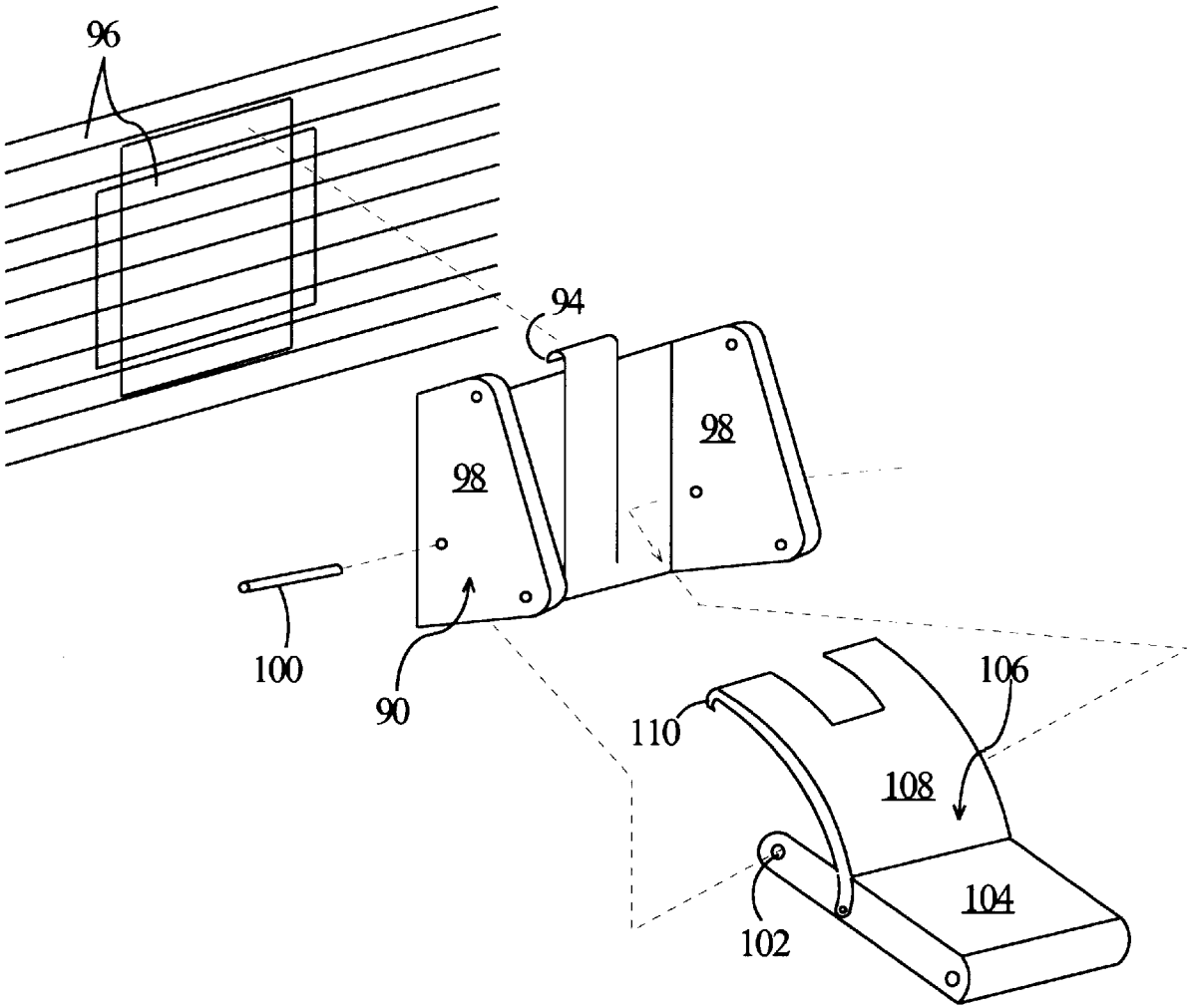
FIG. 8 is a schematic exploded illustration of the embodiment of the latch illustrated in FIGS. 6 and 7.

With reference to FIGS. 6–8, the latch generally includes a first member 90 adapted to be carried by the second adjustment member of the mounts of FIGS. 3–5. The first member 90 includes a first forward facing hook (92 in FIG. 9) at the lower edge of the center section (not shown) adapted to engage an element on the antenna. The center section of the first member also desirably carries a spring biased element 94 adapted to engage one of the slots 96 in the antenna to provide stability of the antenna during the latching operation.

The flanges 98 of the first member 90 may be provided with apertures to receive a pin 100 which passes through a hole 102 adjacent one end of the flat member 104 of a second member 106 so that the flat member may pivot about the pin 100. Approximately midway along the flat member 104 is hinged a curved member 108 which has at the distal end thereof a second hook 110 adapted to engage an element of the antenna. Alternatively, suitable protrusions from the sides of the flat member 104 may engage a detent on the curved member 108 to provide the pivotal connection.

Figure 9:
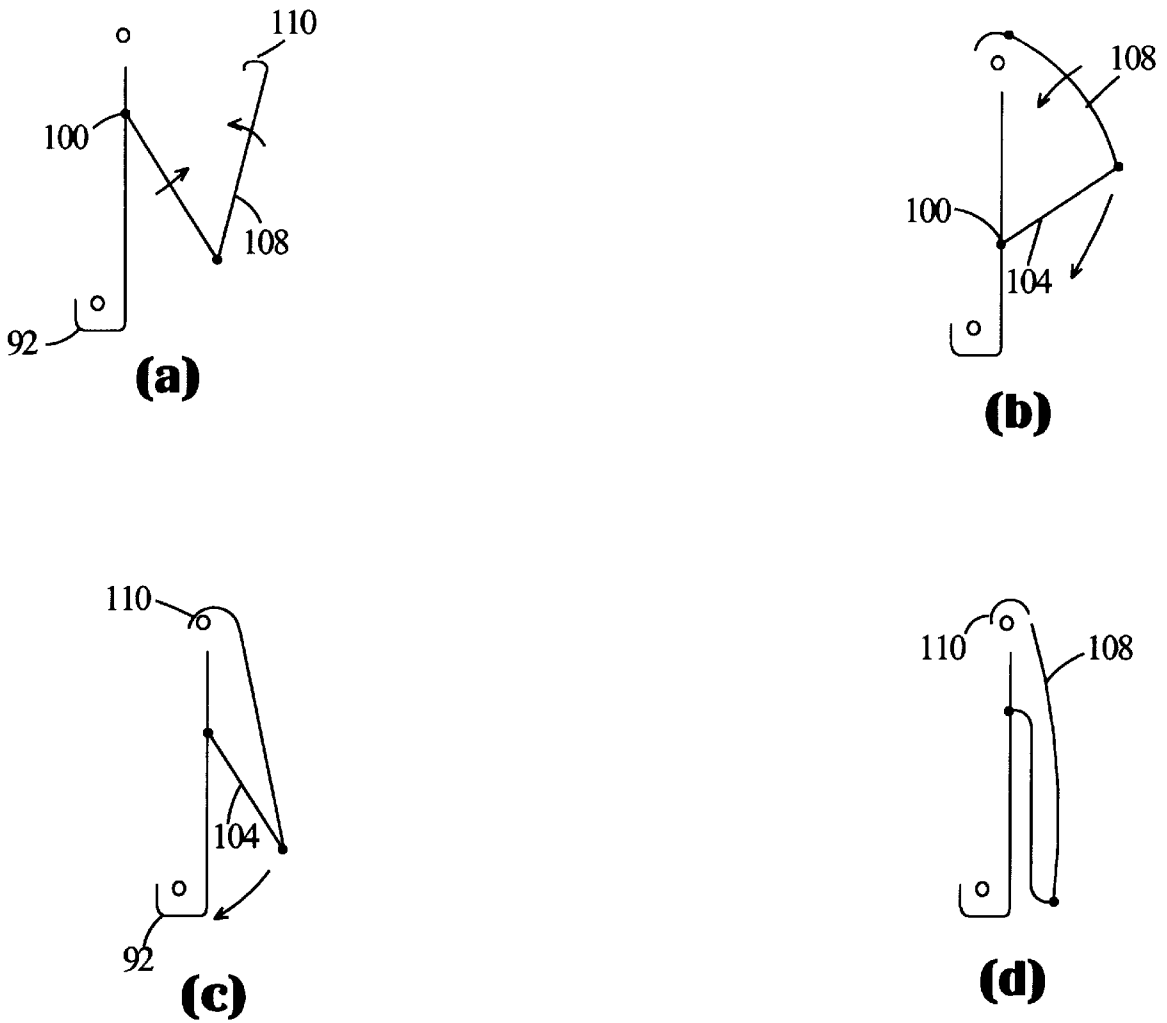
FIGS. 9(*a*) through 9(*d*) are schematic illustrations of the operation of the embodiment of the quick connect/disconnect latch mechanism of FIGS. 6–8.

In operation, and as shown in FIG. 9(*a*), the first member is placed against the antenna with the lower hook 92 engaged and both the flat member 104 and the curved member 108 out of contact with the antenna. As shown in FIG. 9(*a*), both the flat and curved members may then be rotated counterclockwise to position the hook 110 in position to engage the antenna. Once the hook 110 is engaged, the flat member 104 may be rotated clockwise into the latched position shown in FIG. 9(*d*) and in FIG. 7.

As shown in various of the figures, the antenna is desirably provide with latch receiving means on the back, ends and sides so that the antenna may be selectively latched to the mounting member in the orientation dictated by the antenna element itself.

It should be understood that the foregoing description of preferred embodiments is illustrative only and that various changes, substitutions and alterations can be made herein without departing from the spirit and scope of the invention as defined by the appended claims.

What is claimed is:

1. An antenna mounting bracket for a point-to-multipoint, millimeter wave communication system comprising:

a bracket at one end thereof adapted to be removably fastened to a support member;

a first adjustment member carried by said bracket adjacent to an other end of said bracket, said first adjustment member being selectively rotatable in a first plane;

a second adjustment member carried by said first adjustment member, said second adjustment member being selectively rotatable in a second plane substantially normal to said first plane; and antenna support means carried by said second adjustment member adapted to removably support an antenna in a point-to-multipoint, millimeter wave, wireless communication system, so that an antenna supported by said support means may be selectively oriented in two orthogonal planes.

2. The antenna mounting bracket of claim 1, wherein said first adjustment member includes a generally pie-shaped gear element pivotably mounted radially internally of the arcuate periphery thereof and having a plurality of gear teeth carried by said periphery, said gear element carrying said second adjustment member; and a selectively rotatable driving element engaging of said gear teeth such that the selective rotation of said driving element effects the rotation of said pie-shaped gear element and thus the rotation of any antenna supported by said second adjustment member in aid first plane.

3. The bracket of claim 2, wherein said driving element includes a selectively rotatable worm gear cylinder the threads of which engage the gear teeth of said pie-shaped member to effect the rotation thereof.

4. The antenna mounting bracket of claim 2, wherein said second adjustment member includes a generally pie-shaped second gear element pivotably mounted radially internally of the arcuate periphery thereof and having a plurality of gear teeth carried by said periphery, said second gear element carrying said antenna support means; and a selectively rotatable second driving element carried by said first pie-shaped gear element and engaging the gear teeth of said second pie-shaped gear element such that the selective rotation of said second driving element effects the rotation of said second pie-shaped gear element and thus the rotation of any antenna supported by said second antenna support means in said second plane.

5. The bracket of claim 4, wherein said second driving element includes a selectively rotatable worm gear cylinder the threads of which engage the gear teeth of said second pie-shaped member to effect the rotation thereof in said second plane.

6. The antenna mounting bracket of claim 1, wherein said second adjustment member includes a generally pie-shaped second gear element pivotably mounted radially internally of the arcuate periphery thereof and having a plurality of gear teeth carried by said periphery, said second gear element carrying said antenna support means; and a selectively rotatable second driving element carried by said first adjustment member and engaging the gear teeth of said second pie-shaped gear element such that the selective rotation of said second driving element effects the rotation of said second pie-shaped gear element and thus the rotation of any antenna supported by said second antenna support means in said second plane.

7. The bracket of claim 6, wherein said second driving element includes a selectively rotatable worm gear cylinder the threads of which engage the gear teeth of said second pie-shaped member to effect the rotation thereof in said second plane.

8. The bracket of claim 1 wherein said antenna support means is a quick release latch.

9. The bracket of claim 8 wherein said quick release latch comprises:

a first member having a first hook forwardly extending therefrom, said first hook being adapted to engage an antenna at a first point;

a second member having a second hook forwardly extending therefrom, said second hook being adapted to engage an antenna at a second point spaced from the first point and said second member being pivotably carried by said first member for selectively positioning between:

(a) a first unlatched position where the spacing between said hooks is at least as great as the spacing between the first and second points on the antenna so that said first hook may engage the antenna at the first point without engagement of the antenna by the second hook, and (b) a second latched position where the spacing between said hooks is less than the spacing between the first and second points on the antenna so that the second hook may engage the antenna at the second point while said first hook is in engagement with the antenna at the first point to thereby grasp the antenna at the first and second points; and means for releasably retaining said second member in said latched position.

10. The bracket of claim 9, where the second hook forwardly extending from the second member is pivotably connected to the second member.

11. The bracket of claim 10, where the first member has extending forwardly therefrom a guide member adapted to engage the antenna when said bracket is latched thereto to maintain the orientation of the antenna relative to said bracket.

12. A method of orientating in two orthogonal planes an antenna in a point-to-multipoint millimeter wave communication system comprising the steps of:

(a) providing an antenna bracket having first and second manual adjustments;

(b) removably attaching one end of the bracket to a support;

(c) attaching an antenna to the other end of the bracket;

(d) selectively adjusting the orientation of the antenna relative to the first manual adjustment to thereby effect orientation of the antenna in a first plane;

(e) selectively adjusting the orientation of the first manual adjustment relative to the second manual adjustment to thereby effect orientation of the first adjustment in a second plane orthogonal to the first plane, to thereby effect the adjustment of the orientation of the antenna in two orthogonal planes.

* * * * *